US005603163A

United States Patent [19]

Ikner, Jr.

[11] Patent Number: 5,603,163

[45] Date of Patent: Feb. 18, 1997

[54] SWIVEL SPOON

[76] Inventor: John W. Ikner, Jr., 11235 Co. Rd., 54 West, Daphne, Ala. 36526

[21] Appl. No.: 517,923

[22] Filed: Aug. 22, 1995

[51] Int. Cl.[6] ..... A47G 21/04

[52] U.S. Cl. ..... 30/324; 30/342

[58] Field of Search ..... 30/142, 324–328, 30/340, 342

[56] References Cited

U.S. PATENT DOCUMENTS

| | | | |
|---|---|---|---|
| 2,571,264 | 6/1949 | Lagarra . | |
| 2,636,266 | 4/1953 | Sweet | 30/324 |
| 2,809,426 | 10/1957 | Pickering | 30/324 |
| 3,259,132 | 11/1963 | Katter . | |
| 4,389,777 | 6/1983 | Landsberger | 30/324 |
| 4,993,156 | 2/1991 | Craven | 30/142 |

FOREIGN PATENT DOCUMENTS

| | | | |
|---|---|---|---|
| 2005351 | 8/1971 | Germany | 30/324 |
| 833889 | 5/1960 | United Kingdom | 30/324 |

*Primary Examiner*—Hwei-siu Payer
*Attorney, Agent, or Firm*—Joseph N. Breaux

[57] ABSTRACT

A swivel spoon of the type having a functional member which rotates in relation to a handle is provided. The swivel spoon comprises: a handle and a stem having an elongated section, an angled section, a spoon bowl end, and a first end. A portion of the elongated section is rotatably connected to the handle in a manner such that the spoon bowl rotates in relation to the longitudinal axis of the handle. The angled section extends at an angle between twenty-five and sixty degrees from the longitudinal axis of the elongated section of the stem. The spoon bowl extends from the angled section parallel with the handle and the elongated section of the stem.

6 Claims, 3 Drawing Sheets

SWIVEL SPOON

TECHNICAL FIELD

The present invention relates to eating utensils and more particularly to eating utensils that have a functional member which rotates in relation to the handle.

BACKGROUND ART

Those with poor hand muscle and/or motor control such as young children or those suffering from conditions such as arthritis, general physical weakness or post-operative conditions have difficulty in grasping eating utensils and bringing the utensil to the mouth without spillage. Attempts have been made to weight these utensils or to provide a functional member with a straight stem that rotates to accommodate these users. However, these attempts have not heretofore been entirely satisfactory.

It would be a benefit, therefore, to have a swivel spoon that has a spoon bowl rotatably connected to a handle by a stem having an elongated section and an angled section. It would be a further benefit to have an angled stem section which acts as a moment arm. It would be a still further benefit to have an oversized handle for easy grasping.

GENERAL SUMMARY DISCUSSION OF INVENTION

It is thus an object of the invention to provide a swivel spoon that has an elongated stem section and an angled stem section rotatably connected to a handle in a manner such that a spoon bowl rotates in relation to the longitudinal axis of the handle maintaining the spoon bowl in a upright position.

It is a further object of the invention to provide a swivel spoon that has an angle stem section that extends at an angle between twenty-five and sixty degrees from the elongated stem section.

It is a still further object of the invention to provide a swivel spoon that has a spoon bowl that extends from the angled stem section parallel with the handle and the elongated stem section.

It is a still further object of the invention to provide a swivel spoon that has an oversized handle to facilitate grasping.

Accordingly, a swivel spoon of the type having a functional member which rotates in relation to a handle is provided. The swivel spoon comprises: a handle and a stem having an elongated section, an angled section, a spoon bowl end, and a first end.

The handle may be made of any material suitable for an eating utensil such as plastic, steel or ceramic. The handle is sized to facilitate grasping by a young child or a person who has limited dexterity.

In a preferred embodiment, the handle is constructed in two halves to form a cylindrical handle. The handle forming a pathway therein for rotatably entrapping a portion of the elongated section of the stem. The pathway having a first portion extending along the longitudinal axis of the handle and a second portion having an inside diameter larger than that of the first portion.

The stem may be made of plastic, silver, steel or silver plated steel. The first end of the stem and a portion of the elongated section are rotatably disposed within the pathway. The stem may be retained in the handle by an O-ring, snap ring, flange or by any other means for rotatably maintaining the stem in the handle known in the art.

The angled section extends from the elongated section at an angle between twenty-five and sixty degrees from the longitudinal axis of the elongated section. Preferably, the angled section extends at a forty-five degree angle. The spoon bowl end extends form the angled section aligned parallel with the handle and the elongated section of the stem. The angled section acts as a moment arm such that when the hand is moved the spoon bowl rotates about the longitudinal axis of the handle maintaining the spoon in an upright position.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
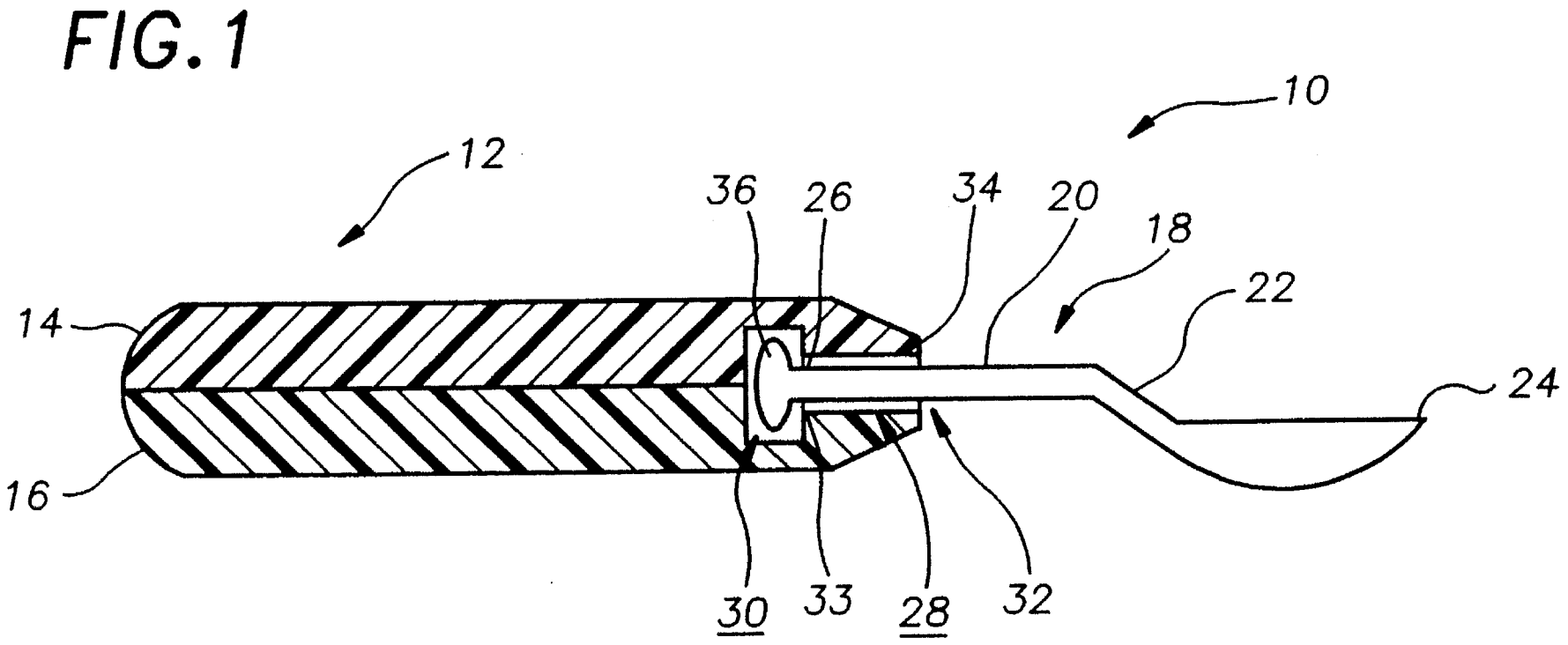
FIG. 1 is a sectional, side view of an exemplary embodiment of the swivel spoon of the present invention.

FIG. 1 is a sectional, side view of an exemplary embodiment of the swivel spoon of the present invention generally designated by the numeral 10. swivel spoon 10 includes a handle generally designated 12 having a top section 14 and a bottom section 16, and a stem generally designated 18 having an elongated section 20, an angled section 22, a spoon bowl end 24 and a first end 26.

Top section 14 and bottom section 16 are individually formed of unitary construction from plastic by a molding technique. Each of the handle sections are facewise disposed upon each other in marginal registration and fastened by glueing to form a cylindrical handle 12 as shown in FIG. 1. Handle 12 is oversized to facilitate grasping by a young child or by a person having limited dexterity or use of a hand.

Handle 12 defines a pathway therein having a first portion 28 and a second portion 30. First portion 28 is formed along the longitudinal axis of handle 12 having a end opening 32 defined by a front face 34 of handle 12. Second portion 30 is formed at the terminal end 33 of first portion 28 and is of a larger inside diameter than first portion 28.

Stem 18 is formed of steel. A circular flange 36 is formed on first end 26 of stem 18. Angled section 22 extends from elongated section 20 at a forty-five degree angle from the longitudinal axis of elongated section 20. Spoon bowl end 24 extends form angled section 22 aligned parallel with handle 12 and elongated section 20 of stem 18.

As shown in FIG. 1, swivel spoon 10 is constructed in the following manner. Top and bottom section 14,16 of handle 12 are individually molded in a manner defining half of first and second pathway portions 28,30. Each of the handle sections are facewise disposed upon each other in marginal registration and fastened by glueing with elongated section 20 rotatably disposed within first pathway portion 28 and flange 36 rotatably entrapped within second pathway portion 30.

Figure 2:
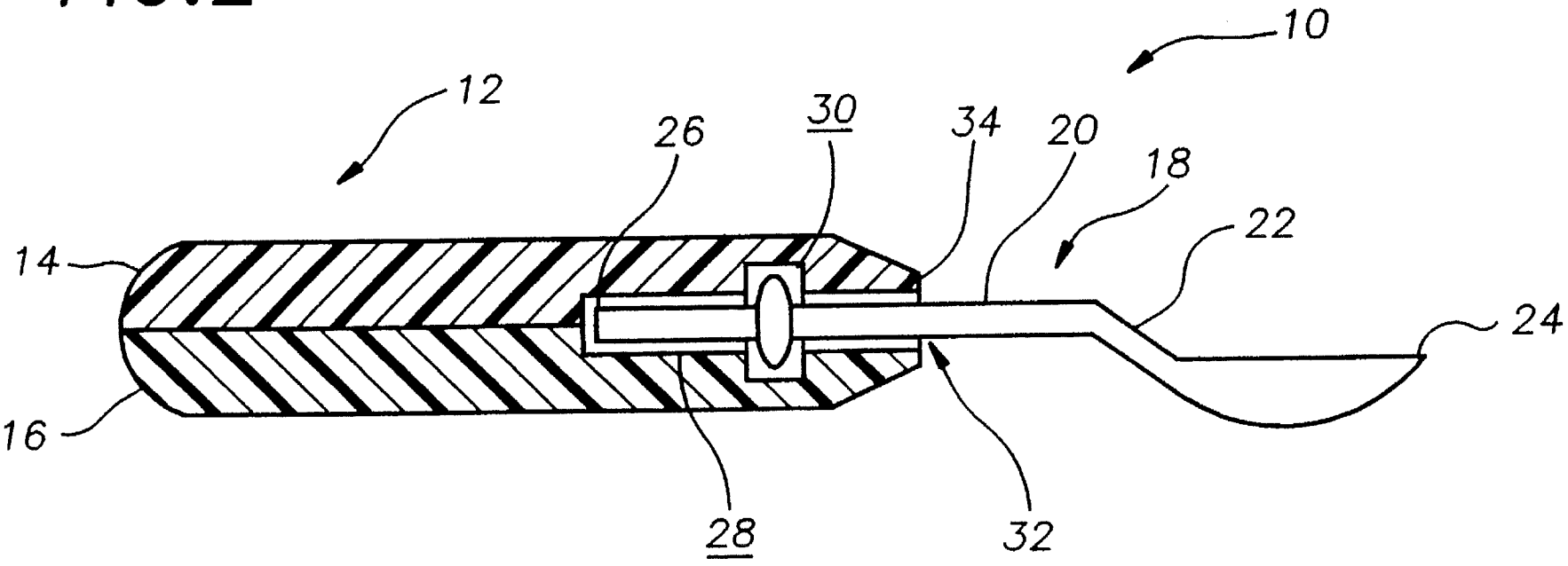
FIG. 2 is a sectional, side view of another exemplary embodiment of the swivel spoon of the present invention.

FIG. 2 is side view of another exemplary embodiment of the swivel spoon of the present invention generally designated by the numeral 10*a*. Swivel spoon 10*a* includes a handle generally designated 12*a* (shown in cross section) having a top section 14*a* and a bottom section 16*a*, and a stem generally designated 18*a* having an elongated section 20*a*, an angled section 22*a*, a spoon bowl end 24*a* and a first end 26*a*.

Top section 14*a* and bottom section 16*a* are individually formed of unitary construction from plastic by a molding technique. Each of the handle sections are facewise disposed upon each other in marginal registration and fastened by glueing to form a cylindrical handle 12*a* as shown in FIG. 2. Handle 12*a* defines a pathway therein having a first portion 28*a* and a second portion 30*a*. First pathway portion 28*a* is formed along the longitudinal axis of handle 12*a* having an end opening 32*a* defined by a front face 34*a* of handle 12*a*. Second pathway portion 30*a* is formed about the mid-point of first pathway portion 28*a*. Second pathway portion 30*a* has a larger inside diameter than first pathway portion 28*a*.

Stem 18*a* is formed of steel. A ball bearing assembly 38*a* is attached in a manner rotatably disposing elongated section 20*a* between first end 26*a* and angled section 22*a* of stem 18*a*. Angled section 22*a* extends from elongated section 20*a* at a forty-five degree angle from the longitudinal axis of elongated section 20*a*. Spoon bowl end 24*a* extends form angled section 22*a* aligned parallel with handle 12*a* and elongated section 20*a* of stem 18*a*.

As shown in FIG. 2, swivel spoon 10*a* is constructed in the following manner. Top and bottom section 14*a*,16*a* of handle 12*a* are individually molded in a manner defining half of first and second pathway portions 28*a*,30*a*. Each of the handle sections are facewise disposed upon each other in marginal registration and fastened by glueing with a portion of elongated section 20*a* rotatably disposed within first pathway portion 28*a* and ball bearing assembly 38*a* entrapped within second pathway portion 30*a*.

Figure 3:
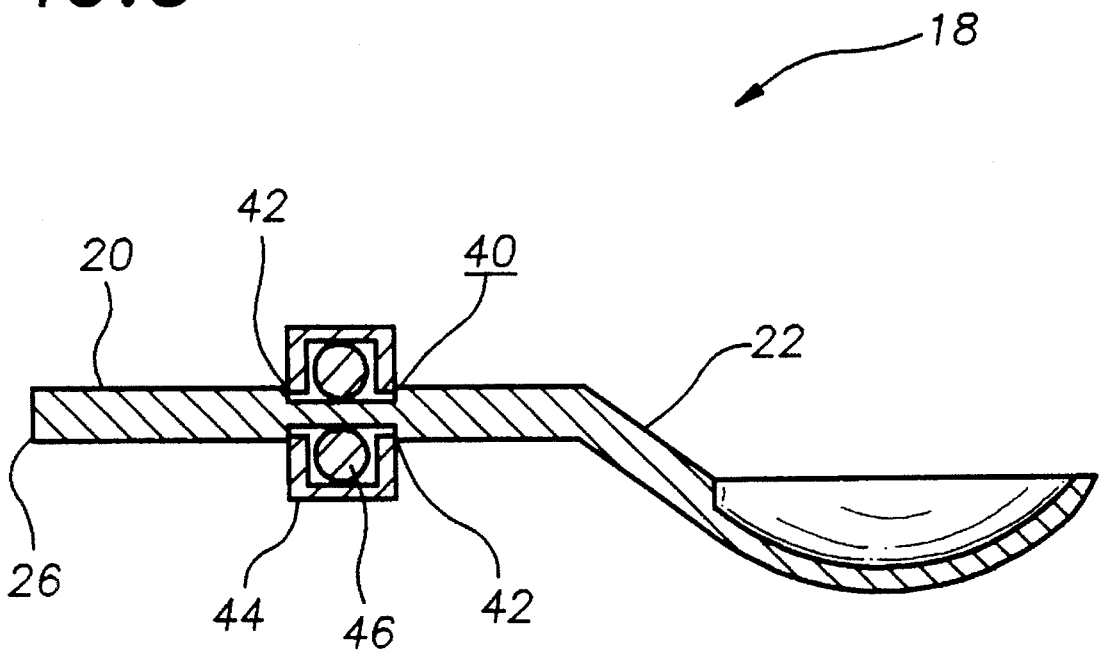
FIG. 3 is a cross-sectional, side view of the stem as shown in FIG. 2.

FIG. 3 is a cross-sectional, side view of stem 18*a* as shown in FIG. 2. Elongated section 20*a* forms a recess 40*a* between first end 26*a* and angled section 22*a* defined by shoulders 42*a*. Ball bearing housing 44*a* is retained within recess 40*a* by shoulders 42*a*. Ball bearings 46*a* contact elongated section 20*a* within recess 40*a* allowing stem 18*a* to smoothly rotate along its longitudinal axis.

Use of the swivel spoon 10 is now described with reference to FIGS. 1–3. Handle 12,12*a* may be gripped by the user for dipping spoon bowl 24,24*a* into food. As the spoon bowl is brought to the user's mouth the user's hand may be unsteady or as in a child the movement may be uncoordinated. Movement or twisting of the handle 12,12*a* will create a force acting through the angled section 22,22*a* of the stem 18,18*a* causing the spoon bowl 24,24*a* to rotate about the longitudinal axis of the handle 12,12*a* maintaining the spoon bowl 24,24*a* in an upright position.

It can be seen from the preceding description that an eating utensil which has an elongated stem section and an angled stem section rotatably connected to a handle in a manner such that a spoon bowl rotates in relation to the longitudinal axis of the handle maintaining the spoon bowl in a upright position, has an angle stem section that extends at an angle between twenty-five and sixty degrees from the elongated stem section, has a spoon bowl that extends from the angled stem section parallel with the handle and the elongated stem section, and has an oversized handle to facilitate grasping has been provided.

It is noted that the embodiment of the swivel spoon described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A swivel spoon comprising:

a handle having a front face;

said handle forming a pathway along its longitudinal axis, said pathway having a first portion and a second portion having a larger inside diameter than that of said first portion;

said front face defining an opening to said pathway;

a stem having an elongated section, an angled section, a spoon bowl end, and a first end;

said angled section extending at an angle between twenty-five and sixty degrees from the longitudinal axis of said elongated section;

said spoon bowl end extending from said angled section parallel to said elongated section of said stem;

said elongated section of said stem forming a recess defined by shoulders; and a ball bearing assembly having a housing containing ball bearings, said housing being retained within said recess by said shoulders, said ball bearings contacting said stem within said recess;

said ball bearing assembly being entrapped within said second pathway portion, said elongated section having a portion thereof rotatably disposed in said first pathway portion in a manner such that said spoon bowl end rotates in relation to the longitudinal axis of said handle.

2. A swivel spoon comprising:

a handle having a front face;

a stem rotatably connected to said handle, said stem having an elongated section, an angled section, a spoon bowel end, and a first end, said elongated section of said stem forming a recess defined by shoulders; and a ball bearing assembly having a housing containing ball bearings;

said handle forming a pathway having a first and a second portions therein for rotatably disposing said first end and a portion of said elongated section of said stem, said front face defining an opening to said pathway, said first pathway portion being formed along the longitudinal axis of said handle, said second pathway portion having an inside diameter larger than the inside diameter of said first pathway portion;

said housing being retained within said recess by said shoulders, said ball bearings contacting said stem within said recess; and said ball bearing assembly being entrapped within said second pathway portion.

3. The swivel spoon of claim 2, wherein:

said angled section of said stem extends at an angle between twenty-five and sixty degrees from the longitudinal axis of said elongated section of said stem.

4. The swivel spoon of claim 3, wherein:

said spoon bowl end extends from said angled section of said stem parallel with said elongated section of said stem and said handle.

5. The swivel spoon of claim 2, wherein:

said angled section of said stem extends at a forty-five degree angle from the longitudinal axis of said elongated section of said stem.

6. The swivel spoon of claim 5, wherein:

said spoon bowl end extends from said angled section of said stem parallel with said elongated section of said stem and said handle.

* * * * *